US009614290B1

(12) United States Patent
Remski

(10) Patent No.: US 9,614,290 B1
(45) Date of Patent: Apr. 4, 2017

(54) EXPANDING LATTICE NOTCH ARRAY ANTENNA

(71) Applicant: Raytheon Company, Waltham, MA (US)

(72) Inventor: Richard T. Remski, Grand Prairie, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/958,235

(22) Filed: Dec. 3, 2015

(51) Int. Cl.
*H01Q 13/10* (2006.01)
*H01Q 21/06* (2006.01)
*H01Q 21/20* (2006.01)

(52) U.S. Cl.
CPC ..... *H01Q 21/064* (2013.01); *H01Q 13/10* (2013.01); *H01Q 21/06* (2013.01); *H01Q 21/061* (2013.01); *H01Q 21/20* (2013.01)

(58) Field of Classification Search
CPC ..... H01Q 13/10; H01Q 13/08; H01Q 21/06; H01Q 21/061
USPC ..... 343/770, 767
See application file for complete search history.

(56) References Cited

U.S. PATENT DOCUMENTS 5,220,330 A 6/1993 Salvail et al.
6,005,531 A 12/1999 Cassen et al.
6,034,633 A 3/2000 Cassen et al.
6,839,036 B1 * 1/2005 Apostolos ..... H01Q 1/36 343/767
7,057,570 B2 * 6/2006 Irion, II ..... H01P 5/10 343/725
8,350,773 B1 * 1/2013 Kindt ..... H01Q 13/085 343/767
8,736,505 B2 * 5/2014 Lambert ..... H01Q 13/085 343/767
9,270,027 B2 * 2/2016 Waschenko ..... H01Q 13/10

OTHER PUBLICATIONS

U.S. Appl. No. 15/071,457, filed Mar. 16, 2016, Nipper.
PCT International Search Report and Written Opinion of the ISA for PCT No. PCT/US2015/054400 dated Jan. 27, 2016; 11 pages.

* cited by examiner

*Primary Examiner* — Hoang V Nguyen
(74) *Attorney, Agent, or Firm* — Daly, Crowley, Mofford & Durkee, LLP

(57) ABSTRACT

The present disclosure is directed toward a notch array antenna comprised of a plurality of notch antenna elements projecting from a surface of a base plate at varying angles to provide an array having an expanding element structure. The plurality of notch antenna elements are organized in a regular spacing in one or two directions along the surface of the base plate and each of the plurality of notch antenna elements is formed by a gap between conductive parts projecting from the first surface of the base plate. The notch array antenna includes a plurality of notch antenna element axes, whereby each notch antenna element axis is defined along a centerline of one of the notch antenna elements. Each notch antenna element axis may extend from the first surface of the base plate at systematically varying angles with respect to an axis perpendicular to the base plate.

20 Claims, 10 Drawing Sheets

EXPANDING LATTICE NOTCH ARRAY ANTENNA

GOVERNMENT INTERESTS

This invention was made with the government support under Contract No. N00019-13-C-0128 awarded by the U.S. Navy. The government has certain rights in this invention.

BACKGROUND

As known in the art, notch antenna elements (or more simply "notches") are frequently used in the design of linear and planar array antennas. Such arrays may operate with multiple polarizations. The spacing between notches is referred to as the lattice constant of the array, and is constrained by electromagnetic principles to be no greater than a certain value in order to prevent unwanted array characteristics known as Bragg or grating lobes. On the other hand, minimum spacing is constrained by the ability to package and integrate the electronics to provide signals to and from the array, as well as the economics of total antenna element and active channel count which increases with decreasing spacing between elements in the array.

Attempts to properly size array antennas using notch radiators in confined spaces, such as airborne pods, missile bodies, wing leading edges, etc. is therefore a balance between ideally maximizing the total array area while fitting within available volume. If it is necessary to package electronics more densely than desired for the array, a "dilation" layer is typically employed which mechanically translates the necessary connections from the electronics spacing to the notch element spacing. This dilation adds depth to the overall system and adds signal loss in the system.

Correspondingly, in the opposite direction, if electronics cannot be packaged down to the scale needed for the desired array spacing that prevents grating lobes, a dilation layer with a negative scale factor permits connection of the necessary feeds from the larger electronics spacing to the smaller array element spacing. This too adds depth to the overall installation and incurs power losses.

SUMMARY

The present disclosure is directed toward an expanding lattice notch antenna that includes a plurality of notch antenna elements extending from a surface of a base plate. The properties and dimensions of the notch antenna elements can be manipulated in order to provide an expanding notch array antenna whereby an area of a base portion of the array is different from an area of a top portion of the array, without increasing an overall height of the notch array antenna. By modifying the spatial relationships between notch antenna elements in the array while at the same time maintaining a height of the notch array antenna, an expanding lattice notch array antenna is provided which avoids both an increase to overall assembly depth and the additional path losses associated with the dilation as a separate layer.

According to one aspect of the concepts, systems and techniques described herein an expanding lattice notch array antenna includes a base plate having first and second opposing surfaces, and a plurality of notch antenna elements organized in a regular spacing in one or two directions along the first surface of the base plate. Each of the plurality of notch antenna elements is formed by a gap between a pair of conductive fin-shaped members projecting from the first surface of the base plate. Thus, a first end of each notch element is coupled to a first surface of the base plate and a second end of each notch element extends above the first surface of the base plate. Each notch element has an axis defined along a centerline of the notch. The notch antenna elements in the array are disposed such that each notch antenna element axis extends from the first surface of the base plate at systematically varying angles with respect to an axis perpendicular to the base plate.

In an embodiment, notch antenna elements in the notch array have systematically varying lengths, such that the second ends of each notch antenna element lie on a plane parallel to and spaced apart from a plane defined by the first surface of the base plate. In some embodiments, the lengths of each of the notch antenna elements may differ such that the second endpoints of each notch antenna element do not lie in a plane parallel to the first surface of the base plate.

In some embodiments, a spacing between the first ends of each notch antenna element (e.g., a point on the axis of the notch antenna element which lies on a plane defined by the first surface of the base plate) is less than the spacing between the second ends of each notch antenna element at a top of the notch array antenna (e.g., the spacing between points which lie on the axis of the notch element and which lie on a plane spaced apart from and perpendicular to the plane defined by the first surface of the base plate). The baseplate may optionally include a connecting grid to support the notch antenna elements.

In some embodiments, an angle at which a notch antenna element extends from the first surface of the substrate with respect to a surface plane of the substrate decreases as a distance of the notch antenna element from a central point of the notch array antenna increases. A base area of each of the plurality of notch antenna elements can be greater than a top area of each of the plurality of notch antenna elements. Alternatively, the base area of each of the plurality of notch antenna elements can be less than a top area of each of the plurality of notch antenna elements.

In some embodiments, a pair of intersecting notch antenna elements may be orthogonally disposed to prove a dual polarized notch element. The vertical edge at the boundary where the two orthogonal notch element sides meet forms a spine which in the current state of the art remains orthogonal also to the plane of the base plate, and parallel to the axis down the middle of each notch. In this embodiment, a vector down a spine of the orthogonal notches becomes systematically different from a spinal vector of at least one other notch antenna element with respect to a spinal vector at a central point of the notch array antenna, just as the axis down the middle of each notch antenna element systematically varies.

In some embodiments, the notch antenna element axis may include a first portion that is substantially normal (i.e., orthogonal, straight) with respect to the first surface of the base plate, a second portion disposed at a second angle with respect to the first surface of the base plate, and a third portion that is substantially normal (i.e., orthogonal, straight) with respect to the first surface of the base plate. Alternatively, the notch antenna element axis may include a first portion disposed at a first angle with respect to the first surface of the base plate, a second portion that is substantially normal (i.e., orthogonal, straight) with respect to the first surface of the base plate, and a third portion disposed at a third angle with respect to the first surface of the base plate.

According to another aspect of the concepts, systems and techniques described herein, a tapered notch array includes a base plate having first and second opposing surfaces and a plurality of notch antenna elements projecting from a surface of the base plate and organized in a regular spacing in one or two directions along the first surface of the base plate. Each of the plurality of notch antenna elements is formed by a gap between a pair of conductive fin-shaped elements projecting from the first surface of the base plate and each of the plurality of notch antenna elements has a notch antenna axis corresponding to a central longitudinal axis of the notch antenna element. In an embodiment, the angle at which each notch antenna axis intersects the base plate is different from at least one other notch antenna axis.

In some embodiments, each notch antenna element axis is defined along a centerline of one of the plurality of notch antenna elements. Each notch antenna element axis can extend from the first surface of the base plate at systematically varying angles with respect to an axis perpendicular to the base plate, and each notch antenna element axis in each of the plurality of notch antenna elements has systematically varying lengths, such that a plurality of first endpoints of each notch antenna element axis lie on a plane equidistant in a perpendicular direction to the first surface of the base plate, forming a notch array antenna. In some embodiments, a plurality of first endpoints of each notch antenna element axis coincident with ends of the notch elements lie on a plane spaced apart from and parallel to the first surface of the base plate. The plane is thus spaced a constant height above the base plate surface and each of the notch antenna elements extending from the first surface of the base plate has varying lengths, so as to terminate on the plane.

A spacing between first ends of each notch antenna element at a bottom of the notch array antenna may be less than a spacing between second ends of each notch antenna element at a top of the notch array antenna. The baseplate may include an open grid which defines the spacing of each notch antenna element at the bottom of the notch array antenna.

In some embodiments, an angle at which a notch antenna element extends from the first surface of the substrate changes as a distance of the notch antenna element from a central point of the notch array antenna increases. In one embodiment, a notch antenna element axis includes a first portion that is substantially straight with respect to the first surface of the base plate, a second portion disposed at a second angle with respect to the first surface of the base plate, and a third portion that is substantially straight with respect to the first surface of the base plate. A base area of each of the plurality of notch antenna elements may be greater than a top area of each of the plurality of notch antenna elements. Alternatively, a base area of each of the plurality of notch antenna elements may be less than a top area of each of the plurality of notch antenna elements.

BRIEF DESCRIPTION OF THE DRAWINGS

The foregoing features may be more fully understood from the following description of the drawings in which.

DETAILED DESCRIPTION

The present disclosure is directed toward a notch array antenna (or more simply "notch array") comprised of a plurality of notch antenna elements (or more simply, "notch elements") projecting from a surface of a base plate at varying angles to provide an array having an expanding notch element structure. Such an expansion eliminates the need for dilation and for additional packaging space and also provides the array having an increased aperture size. A resulting increase in array aperture size can provide improved gain for a notch array. This approach may be utilized with linear arrays, planar arrays or any other array configuration.

In some embodiments, the dimensions of one notch antenna element relative to another notch element can be manipulated to expand on array lattice structure without changing an overall height of the notch array. This avoids an increase to an overall array depth and also avoids additional path losses associated with using a separate dilation layer. By varying the lengths of the angled notch antenna elements, a lattice dimensional change (e.g., an effective increase or decrease in antenna element spacing) in the notch array can be provided. Furthermore, the expanding lattice notch antenna allows optimum sizing of a final array aperture while maintaining a planar surface as compared to a conformal array which attempts to follow an outer surface of the platform and thus causing other significant engineering difficulties.

Figure 1:
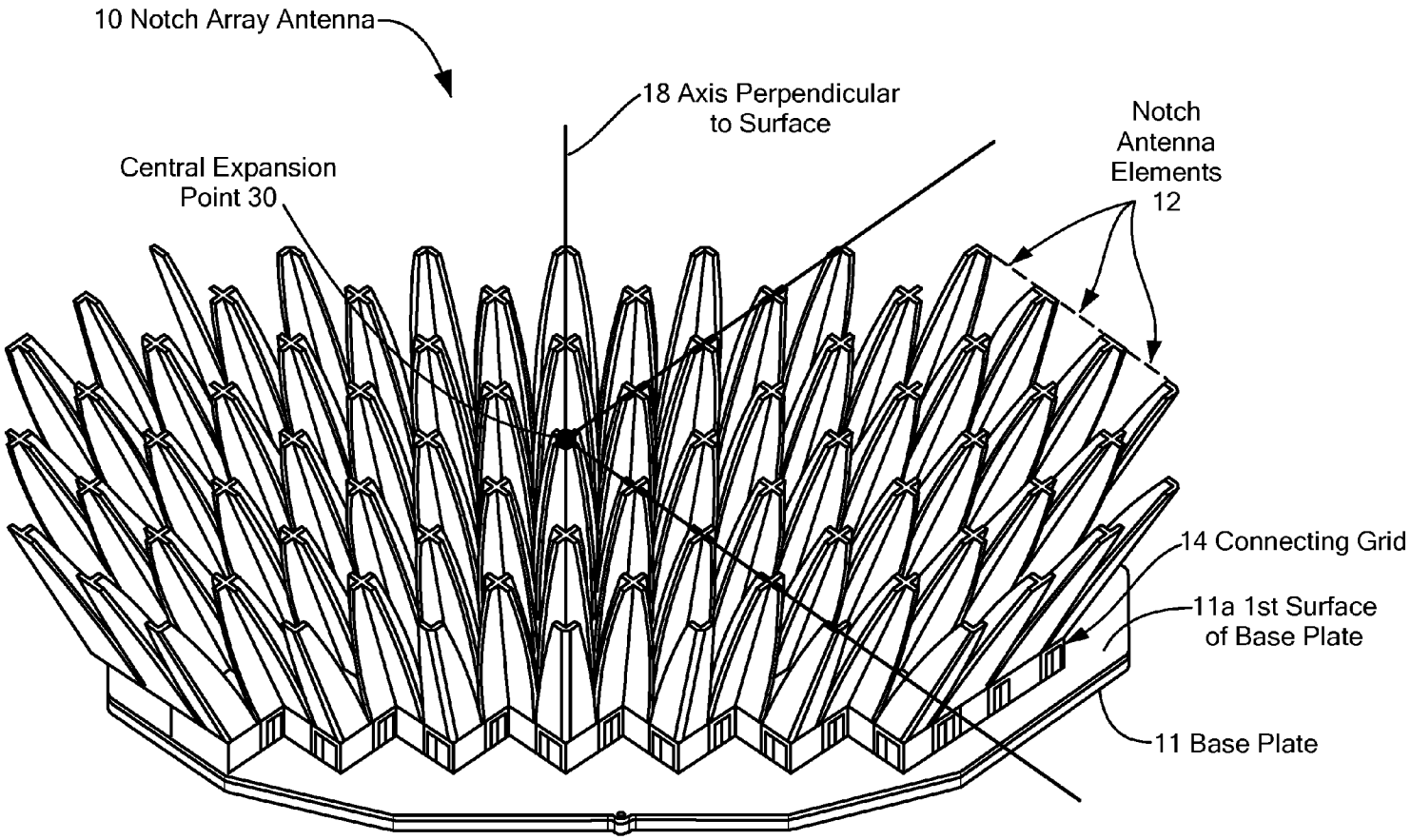
FIG. 1 is an isometric view of an expanding lattice notch array antenna formed on a base plate.
Figure 1A:
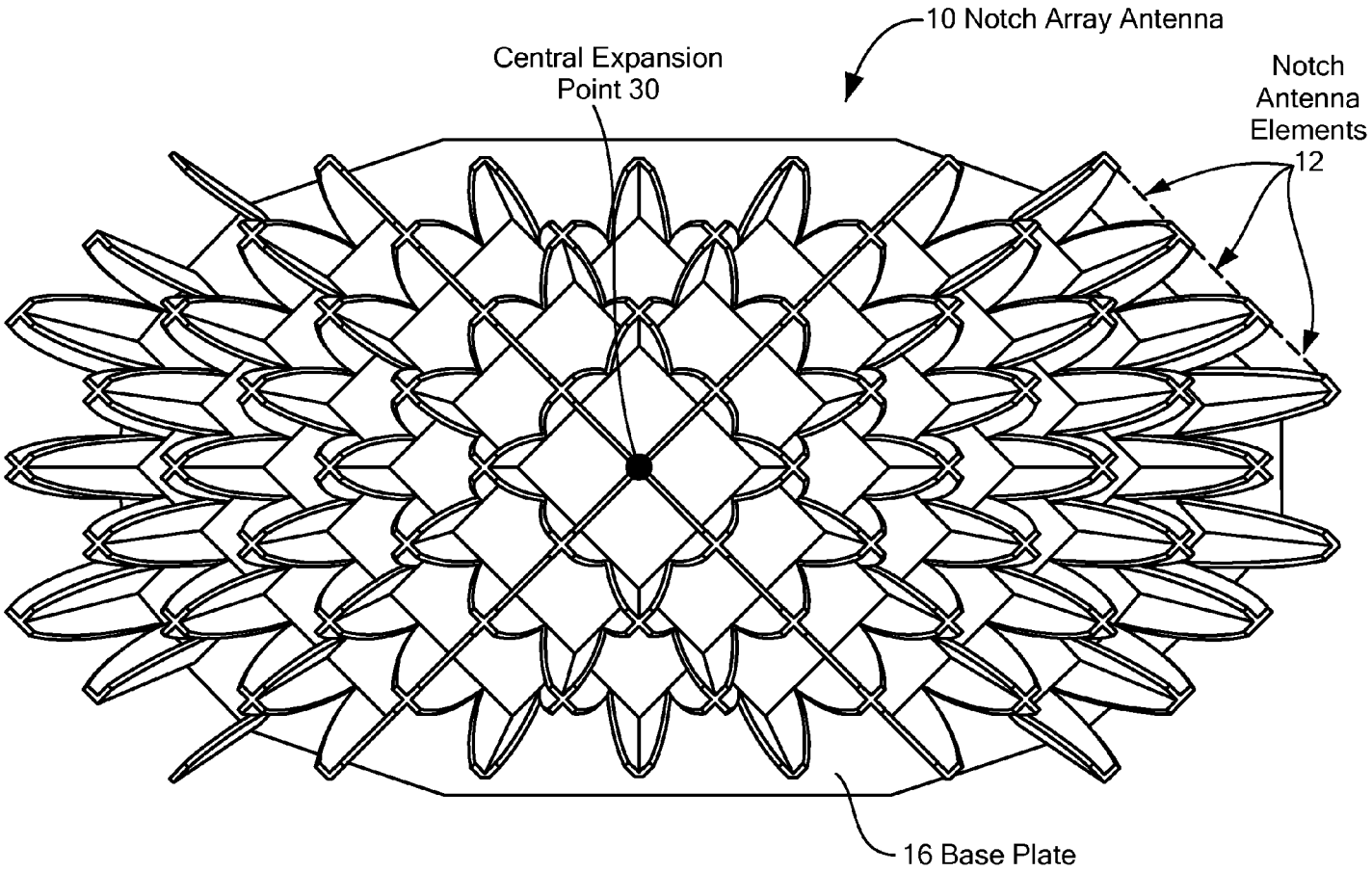
FIG. 1A is a top view of the expanding lattice notch array antenna of FIG. 1.
Figure 1B:
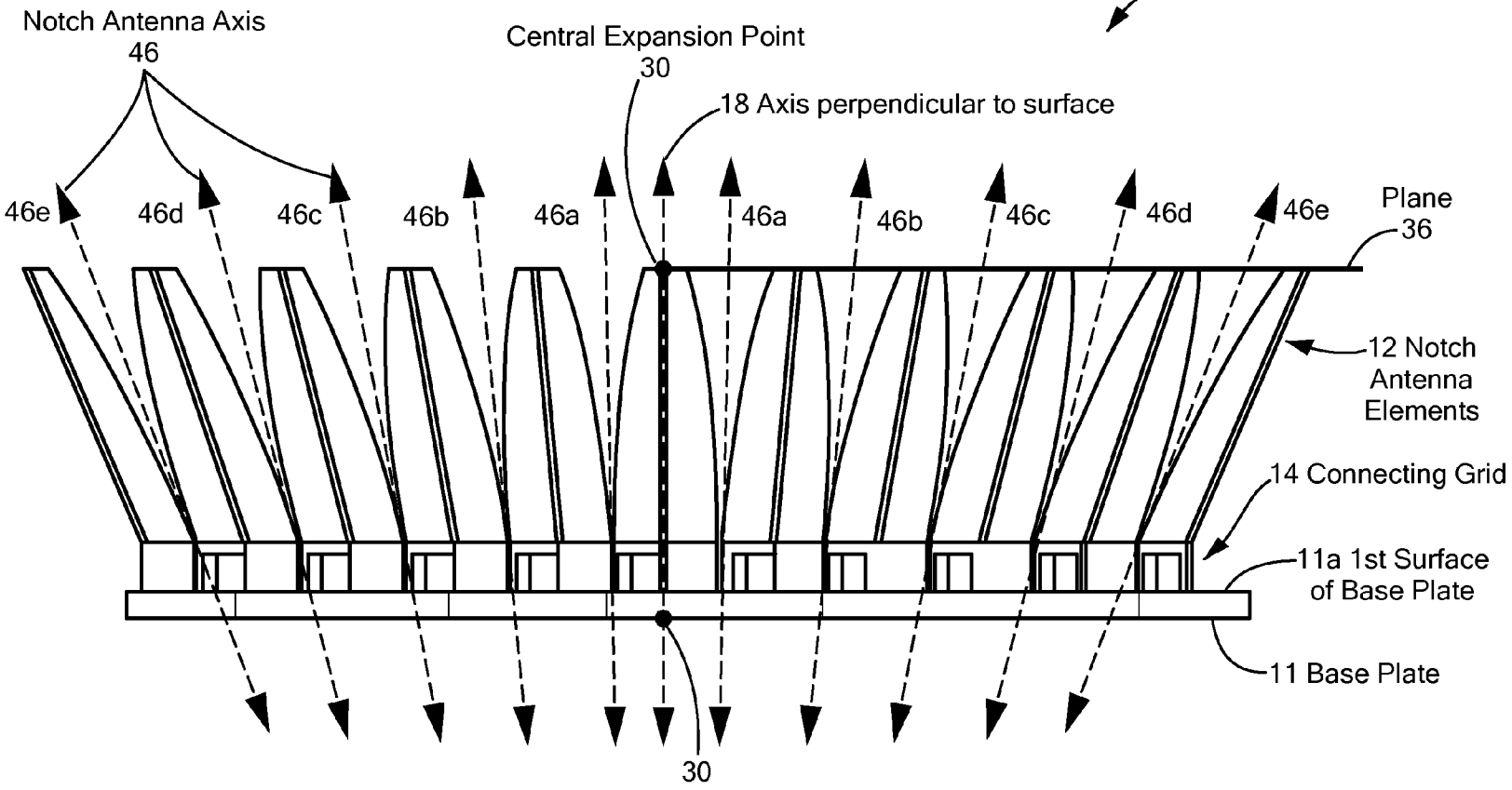
FIG. 1B is a side view of a linear expanding lattice notch array antenna from FIG. 1.
Figure 1C:
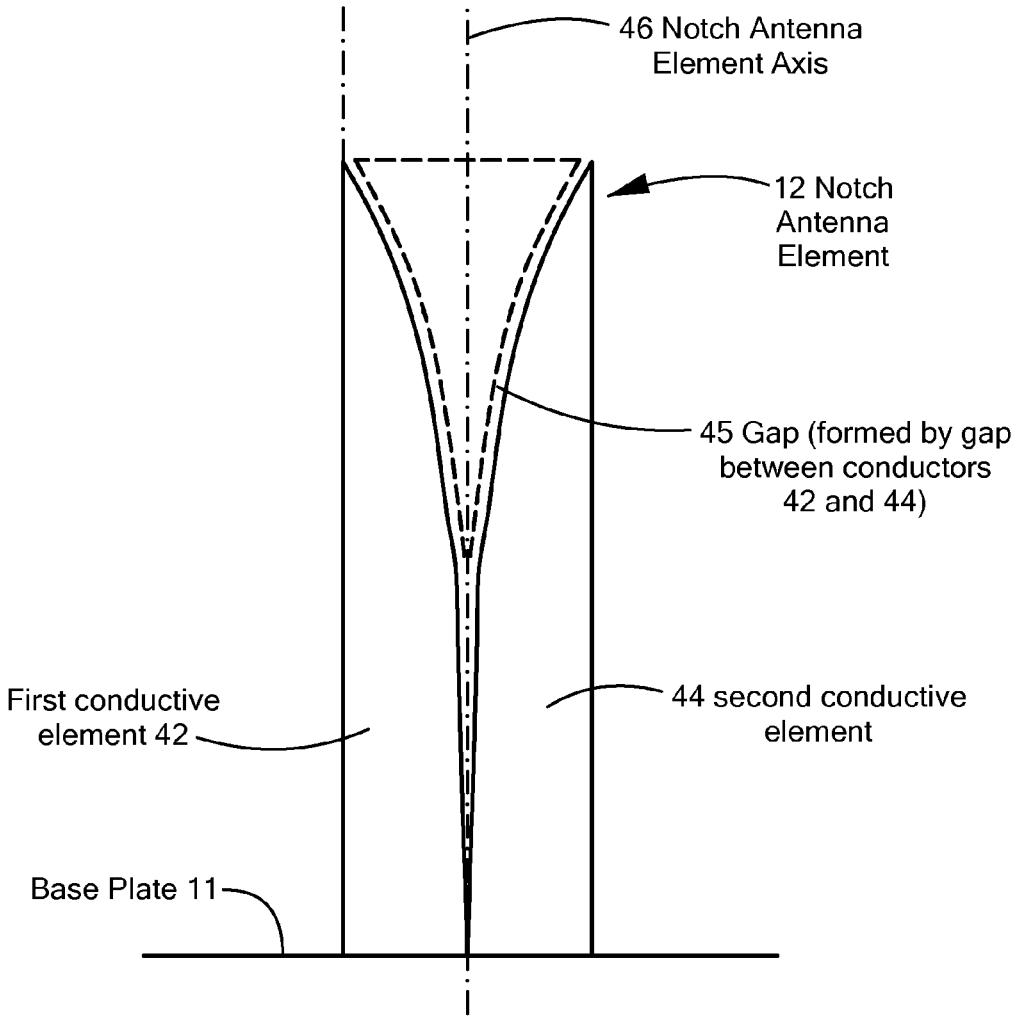
FIG. 1C is a side view of a notch antenna element.

Referring, now to FIGS. 1-1C in which like elements are provided having reference designations throughout several views, a notch array antenna 10 includes a base plate 11 having a plurality of notch antenna elements 12 extending from a first surface 11*a* of the base plate 11. Notch elements 12 extend (or project) from base plate 11 at varying angles to provide array 10 having an expanding element-structure.

In some embodiments, the notch antenna elements 12 are coupled directly to the surface of the base plate 11. In other embodiments, a connecting grid 14 may optionally be disposed over the base plate 11 and may be used to secure the notch antenna elements 12 to the surface of the base plate 11.

First ends of the notch antenna elements 12 are organized in a regular spacing in one or more directions along the base plate surface 11*a*. In the illustrative embodiment of FIG. 1, the notch elements 12 are provided as dual polarized notch antenna elements and are disposed in two orthogonal directions (i.e., x and y directions) along surface 11*a*. Thus, array 10 is provided as a so-called dual polarized planar array. It should, of course, be appreciated that the concepts, systems, and techniques described herein may be applied to single polarized notch elements and to linear arrays or any other array configuration.

Notch antenna elements 12 may be organized relative to an axis 18 that is perpendicular to base plate surface 11*a* and relative to a central expansion point 30 (i.e. a center of lattice expansion). Thus, is this illustrative embodiment a number of unique notch subassemblies are axially symmetric about the center of element expansion 30.

In the notch array 10, one or more of the notch elements 12 may have different dimensions and properties than other elements in the array. For example, the notch elements may have different lengths and/or extend at different angles from base plate surface 11*a*. By varying angles, dimensions and possibly other properties of the notch array elements 12, an expanding lattice notch antenna can be provided whereby an area of a first end (e.g., top, bottom) of the notch array antenna 10 may be greater than an area of a second end (e.g., top, bottom) of the notch array antenna 10. Furthermore, as will be discussed in greater detail below, a spacing between the notch antenna elements 12 at the first end may be different from the spacing between the notch antenna elements 12 at the second end to provide the larger area (i.e., an increased array aperture size) and an improved gain for the notch array antenna 10.

As may be most clearly seen in linear notch array 32 in FIG. 1B, each of the notch antenna elements 12 has a notch element axis 46*a-e* (FIG. 1B) defined along a centerline of the notch. Each of the notch antenna elements 12 are arranged such that axes 46 extends from the surface of the base plate 11 at systematically varying angles with respect to normal axis 18, such that a plurality of end points at second ends of the notch antenna elements 12 lie on a plane 36 spaced apart from and parallel to a plane defined by the surface 11*a* of the base plate 11. Thus, the element centerlines (and thus the notches) are not parallel and thus are not symmetric. Breaking the symmetry between the notch antenna elements 12 in this way permits an area expansion of the notch array antenna aperture.

For example, in the illustrative embodiment of FIG. 1A, axes 46 of notch antenna elements 12 nearest to central expansion point 30 of the notch array antenna 10 extend at angle from baseplate surface 11 which is almost perpendicular from surface 11*a* of the base plate 11. However, as a distance from which a notch antenna element 12 is spaced from central expansion point 30 increases, the angle at which the axis 46 of the respective notch antenna element 12 extends from the surface of the base plate 11 changes. In this illustrative embodiment, the angle of the axis 46 as measured from an outermost edge of the array and from surface 11*a* decreases. For example the angle of axis 46*b* (FIG. 1B) is greater than the angle of axis 46*c* (FIG. 1B) and is also greater than the angle of axis 46*e* (FIG. 1B). Furthermore, in such an embodiment, as the distance from which the notch antenna element 12 is spaced from the central expansion point 30 on the base plate increases, a length of the respective notch antenna element 12 increases relative to a notch antenna element 12 nearer to the central expansion point 30. Increasing the length of the spaced elements 12 results in the second ends of each of the elements 12 terminating in the same plane (e.g., plane 36 in FIG. 1B).

As shown in FIG. 1B, the notch antenna elements 12 begin to taper or flare the further away they are spaced from the central expansion point 30. This organization of the notch antenna elements 12 provides an expansion of the notch array antenna 10. In particular, a base area (i.e. an area proximate base surface 11*a*) of the notch array antenna 10 is smaller than a top area of notch array antenna 10. (i.e. an area at the second ends of the notches distal from base surface 11*a*). For example, a base area of notch array antenna 10 may have dimensions set at below a unit cell grating lobe limit ($d_x$, $d_y$) based on some maximum frequency and scan angle of an intended operation and application. At the base (or bottom) of notch array antenna 10, the array conforms to these limits. However, over a length of the notch antenna elements 12, the notch array antenna 10 expands to a slightly larger notch array antenna 10 at the top (e.g., at plane 36), in which the top spacing of the notch elements 12 at the array aperture is greater but still within an allowable limit based upon a grating lobe limit for the notch array antenna 10.

This expansion results in one or more notch antenna elements 12 tilting at a different angle relative to the normal of the central expansion point 30. Thus, the end result can be: (a) an increased area gain, as the tip of the notch antenna elements 12 have a larger cell size and thus lattice spacing than at the base of the notch array antenna 10; (b) no dilation losses, as there was no need to incorporate a feed distribution layer between electronics and radiator: (c) due to slight 'decollimation' of each notch antenna element 12, broadside gain is slightly decreased in exchange for slightly lower initial gain rolloff with scan off broadside: and (d) there may be virtually no or very small weight change since the growth is all 'in the air' in the notch gaps of each notch antenna element 12.

For example, in one embodiment, in which the cell size is defined as $dx_1=dy_1$ at the base of the array (e.g. unit cell 60*b* in FIG. 3A) and $dx_2=dy_2$ at the tip (or aperture) of the array (e.g. unit cell 60*a* in FIG. 3A), the net area gain is the ratio of $(dx_2/dx_1)^2$. Thus, for a notch array antenna 10 having 60 notch antenna elements with 5% expansion between $dx_1$ and $dx_2$ may result in adding the area which is the equivalent of adding six (6) additional conventional unit cells. In some embodiments, the number of notch antenna elements 12 used in notch array 10 are selected such that they are axially symmetric about central expansion point 30.

It should be noted that although the central expansion point 30 is illustrated at a center of the array 10, the location of the central expansion point may be selected to suit the needs of a particular application. Thus, any point on the base of the array may be selected as an expansion point from which notch antenna elements 12 may be organized systematically according to the needs of a particular application. The expansion may begin from some selected point on base plate 11 and each subsequent notch antenna element 12, or row or column of notch antenna elements 12, can be oriented differently from a preceding one. For example, the expansion point may be offset or off-center on a surface of base plate 11 with respect to a center point of the array.

In the illustrative linear notch array embodiment of FIG. 1B, notch antenna elements 12 nearest the central expansion point 30 may have a shorter length (as measured along the notch axes 46) relative to notch antenna elements 12 farther away from the central expansion point 30. Furthermore, notch antenna elements 12 nearest to the central expansion point 30 may extend from the surface of the base plate 11 at a larger angle (e.g., closer to perpendicular) than notch antenna elements 12 further away from the central expansion point 30. By varying the lengths of the angled notch antenna elements 12, each endpoint of the plurality of notch antenna elements 12 may lie (i.e., end) in a single plane 36 that runs parallel with a plane defined by the surface of the base plate 11. Thus, the height of the notch array antenna 10 (i.e., the vertical distance from the base plate surface 11*a* to plane 36) remains the same while each of the notch antenna elements 12 "tilt" at varying angles relative to the normal of the central expansion point 30 and a bottom face of notch array antenna 10 and top face of notch array antenna 10 remain planar.

In some embodiments, each notch antenna elements 12 in array antenna 10 has the same or substantially similar design and properties as another notch antenna element 12. Alternatively, one or more notch antenna elements 12 may have varying designs or properties in array antenna 10. For example, one or more notch antenna elements 12 may have varying lengths and thus may behave differently from another notch antenna element 12 in array antenna 10.

Now referring to FIG. 1C, each of the notch antenna elements 12 includes a first conductive element (or conductive fin) 42 and a second conductive element (or conductive fin) 44 projecting from the surface of the base plate 11. A balun (not shown but visible in FIGS. 1-1B as part of connecting grid 14) may be used to couple notch antenna element 12 to the surface of base plate 11. The radiating portion of notch element 12 (i.e., the notch) is formed by a gap (or spacing) 45 between the first and second conductive elements 42, 44. In some embodiments, the notch antenna element 12 may be provided from a substrate having conductive regions disposed thereon or removed to form the notch. In other embodiments, (e.g., as shown in FIG. 1), conductors may be cut or otherwise formed to provide the first and second fins 42, 44. In either case, the gap 45 increases along the length or height of the notch antenna element 12 to match a transmission line impedance at the bottom to a free space impedance at the top. In some embodiments, gap 45 for each notch antenna element 12 may be the same size at any particular height, along a z-axis (i.e., first conductive element 42 and second conductive element 44 are spaced the same distance apart at any at any particular height) above base plate 11. Alternatively, the size of gap 45 for one or more notch antenna elements 12 may be different from another notch antenna element at any particular height above base plate 11.

In some embodiments, first conductive element 42 and second conductive element 44 may be substantially similar with respect to each other in terms of material, shape and properties. Notch antenna element 12 has an axis 46 that can be defined along a centerline of the notch antenna element 12 (e.g., centerline of gap 45 between first conductive element 42 and second conductive element 44). It should be noted that notch antenna elements 12 have a vector describing gap 45 (e.g., a line orthogonal to axis 46 at given height in a z-axis above base plate 11) that is parallel in two orthogonal polarizations planes. In an embodiment, notch antenna element 12 is a tapered notch element. However stepped, or other types of notch elements may also be used.

Figure 2:
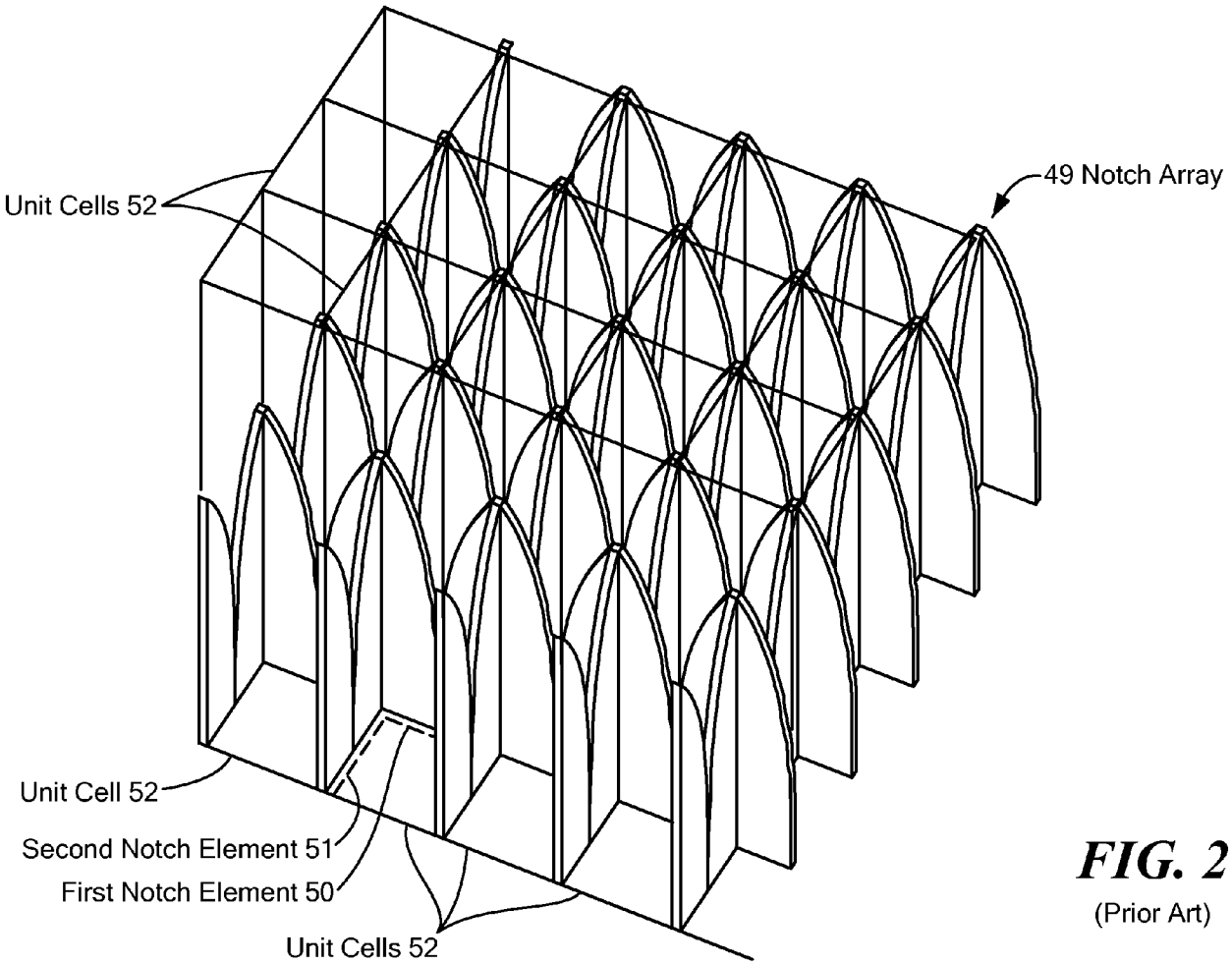
FIG. 2 (Prior Art)
FIG. 2 is an isometric view of a prior art notch array antenna.
Figure 2A:
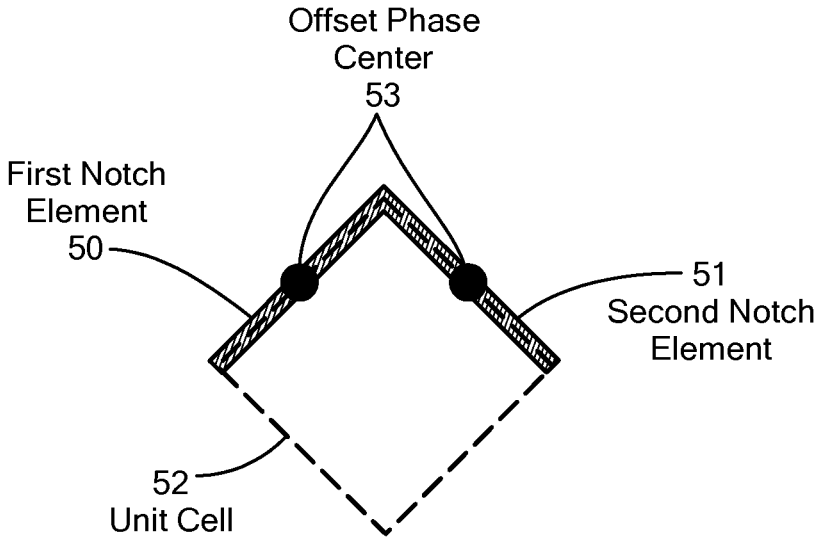
FIG. 2A (Prior Art)
FIG. 2A is a top view of a unit cell of the prior art notch array antenna of FIG. 2.

Now referring to FIGS. 2 and 2A, a portion of conventional notch array 49 is shown from a plurality of orthogonally disposed notch elements 50, 51, with each notch element disposed in one of a plurality of unit cells 52. Each unit cell 52 includes a pair of orthogonal elements 50, 51 (FIG. 2A). Each unit cell 52 in conventional array 49 defines an area containing at least one notch antenna element. In dual-polarized array 49, each unit cell 52 contains one notch antenna element in a first plane (e.g., first notch element 50) and one notch antenna element in a second orthogonal plane (second notch element 51). Significantly, the area of each unit cell 52 is the same at both the top and bottom of the array 49.

As illustrated in FIG. 2A, the first and second notch elements 50, 51 intersect at one of their respective edges and thus their respective phase centers 53 may be offset with respect to the unit cell 52 and be aligned with a border of the unit cell 52. The phase centers 53 correspond to a top point of a notch antenna axis (i.e., vector) of a notch antenna element, such as notch axis 46 in FIG. 1C and notch axis 46*a-e* in FIG. 1B.

Figure 3:
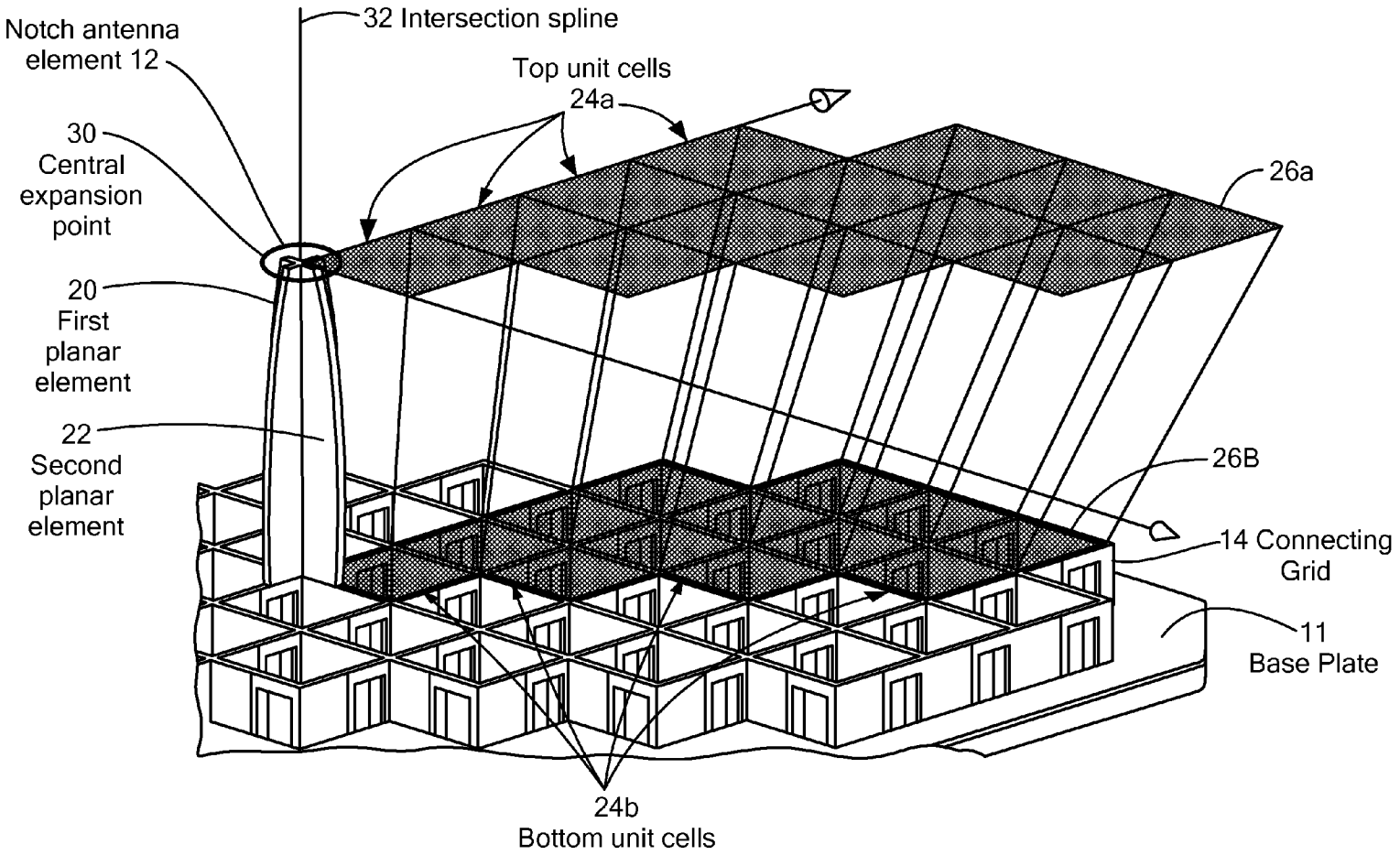
FIG. 3 is an isometric view of an expanding lattice notch array antenna which illustrates unit cells.

Referring now to FIG. 3, unit cells associated with an expanding notch array (such as notch array 10 of FIGS. 1-1B have a unit cell 24*a* at the top of the notch array antenna 10 being different in size from unit cells 24*b* at the bottom of the array. This is due to the expansion of the notch array antenna 10.

In this illustrative embodiment, unit cells 24*a* at the top of the notch array antenna 10 are greater in area than unit cells 24*b* at the bottom of the notch array antenna 10. Each unit cell 24*a* at the top of the notch array antenna 10 is the same size and each unit cell 24*b* at the bottom of the notch array antenna 10 is the same size.

The change in the unit cell 24 sizing from one level (or plane) of the notch array antenna 10 relative to a different level (or plane) is due to the varied angles and properties of the respective notch antenna elements 12 making up the unit cell 24. As an angle at which the notch antenna elements 12 extend from the surface of base plate 11 decreases (as measured from an edge of the base 11) relative to a distance from the central expansion point 30 (e.g., moves farther away from the central expansion point), notch antenna elements 12 systematically flare out at a greater angle relative to a notch antenna element 12 closer to the central expansion point 30. Thus, the length of unit cells 24 (as measured along a central axis of each notch antenna element) as the unit cells move further away from the expansion point.

Base plate 11 may be provided from a conductive material or may be provided as a dielectric substrate having a ground plane disposed over a surface thereof. In some embodiments, base plate 11 is a dielectric substrate having a surface with a conductive material coated or otherwise disposed there over. In other embodiments, base plate 11 may not be a physical solid at all but simply the plane at which the notch antenna elements or connecting grid ends.

Notch antenna elements 12 are disposed on and coupled to base plate 11. As stated above, notch antenna elements 12 may be coupled directly to the base plate 11 or a connecting grid 14 may be used to couple the notch antenna elements 12 to the base plate 11. Connecting gird 14 may be used to control an angle at which notch antenna elements 12 project from the surface of the base plate 11 and may also function to secure the notches to the base plate 11. For example, a portion of notch antenna element 12 that is coupled to or embedded into connecting grid 14 may be substantially perpendicular to the surface of the base plate 11 and the remaining portion of notch antenna element 12 (e.g., portion not embedded within connecting gird 14) may tilt at a desired angle from the surface of the base plate 11.

As shown in FIG. 3, conductive fins intersect and a spinal vector 32 corresponds to an axis at the point of intersection. Spinal vectors 32 associated with unit cells 24 closest to the central expansion point 30 are slightly offset from a perpendicular angle relative to the surface of base plate 11. However, as the distance between a unit cell 24 and the central expansion point 30 increases, the angle of the intersection spine 32 associated with the unit cell 24 differs from the angle of a spine associated with a unit cell 24 closer to central expansion point 32. This change in angle at which the spinal vectors 32 extend from the surface of the base plate 11 may be directly related to the ratio between the size of all unit cells 24*a* vs. 24*b*, the height of the notch, and the total count of elements in the notch antenna array that exist away from the central expansion point.

Figure 3A:
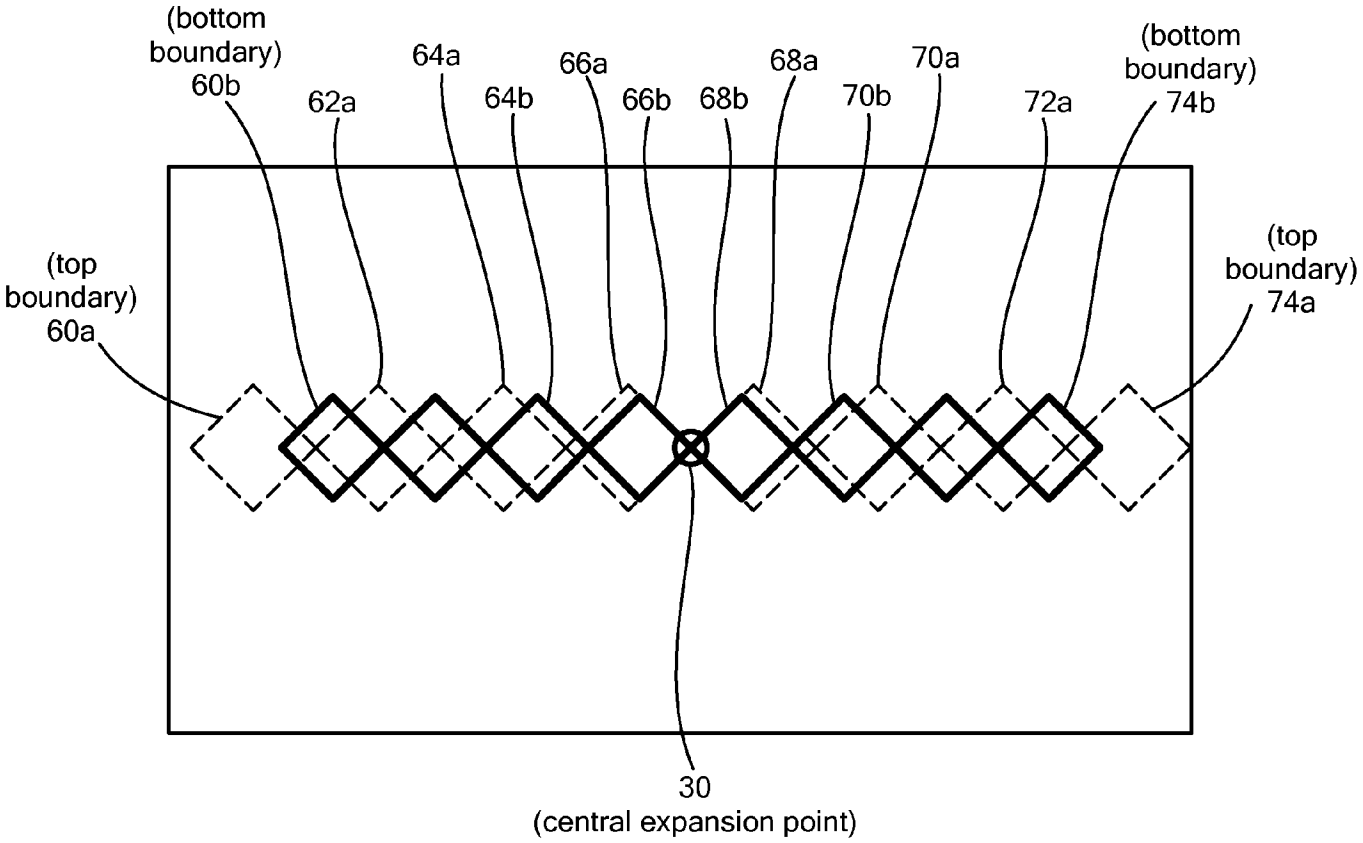
FIG. 3A is a schematic diagram illustrating a top area unit cell boundary overlayed on a bottom area unit cell boundary of the expanding notch lattice notch array of FIG. 3.

Referring now to FIG. 3A, a plurality of top 60*a*-74*a* and bottom 60*b*-74*b* unit cells are shown. As can be seen in FIG. 3A, there is a change in unit cell size from the bottom to the top of notch array antenna 10. Specifically, a top area unit cell indicated by boundary 60*a* of a notch element is greater than a bottom area unit cell indicated by boundary 60*b* of the same notch element. As can be seen in FIG. 3A, the area of a unit cell at the top of the array (i.e., at the end of a notch element furthest from base plate surface 11*a*) as illustrated by element 26*a* in FIG. 3 for example, is increased relative to the area of the unit cell 26*b* at the "bottom" of the notch element (i.e. at the end of the notch element closest to base plate surface 11*a*).

Unit cell outlines 60*a*-74*a* represent the unit cell boundary at the "top" of notch array antenna element 12 and unit cell outlines 60*b*-74*b* represent 60*b* unit cell boundary at the "bottom" of the same notch antenna element. For example, unit cell 60*a* corresponds to the unit cell size at the "top" of one notch array antenna element 12 and unit cell outline 60*b* corresponds to the unit cell size at the "bottom" of the same notch antenna element 12. By varying the angles and lengths of the notch antenna elements relative to central expansion point 30, the top unit cell area of notch array antenna 10 has been increased relative to the bottom unit cell area (i.e., unit cells 24 sizes have increased).

For a dual-polarized array, the scaling factor between the bottom and top unit cells is the same in two orthogonal directions (e.g., uniform). At any cross-section plane parallel to base plate 11 or plane 36 (e.g., FIG. 1B) the metal describing the notch gap remains aligned with the orthogonal polarization planes, as does the gap centered about each axis 46. Thus, the resulting polarizations to which the notch antenna elements 12 are responsive are not geometrically altered when looking at a face of the notch array antenna 10.

Referring again to FIG. 3 it should be appreciated that unit cells 24 can be organized in a Cartesian grid arrangement with an inter-element spacing (dx, dy) and a height (dz) which provides a taper length for broadband matching. Thus, in one illustrative embodiment, a unit cell 24 size (e.g., inter-element spacing) at the bottom can be described as having the relationship $dx_1=dy_1$ and the top can be described as having the relationship $dx_2=dy_2$. In other embodiments, the scaling factor between the bottom unit cells and top unit cells may be non-uniform. For example, a unit cell size at the bottom may be $dx_1=dy_1$ and $dx_2\neq dy_2$ at the top of the notch array antenna 10.

Alternatively, in some embodiments, the unit cells at the top of the notch array antenna 10 may be smaller than the spacing between notch antenna elements at the bottom of notch array antenna 10. For example, in some embodiments, the growth of notch array antenna 10 can be reversed to couple a smaller notch array lattice to a larger electronics lattice.

Figure 4:
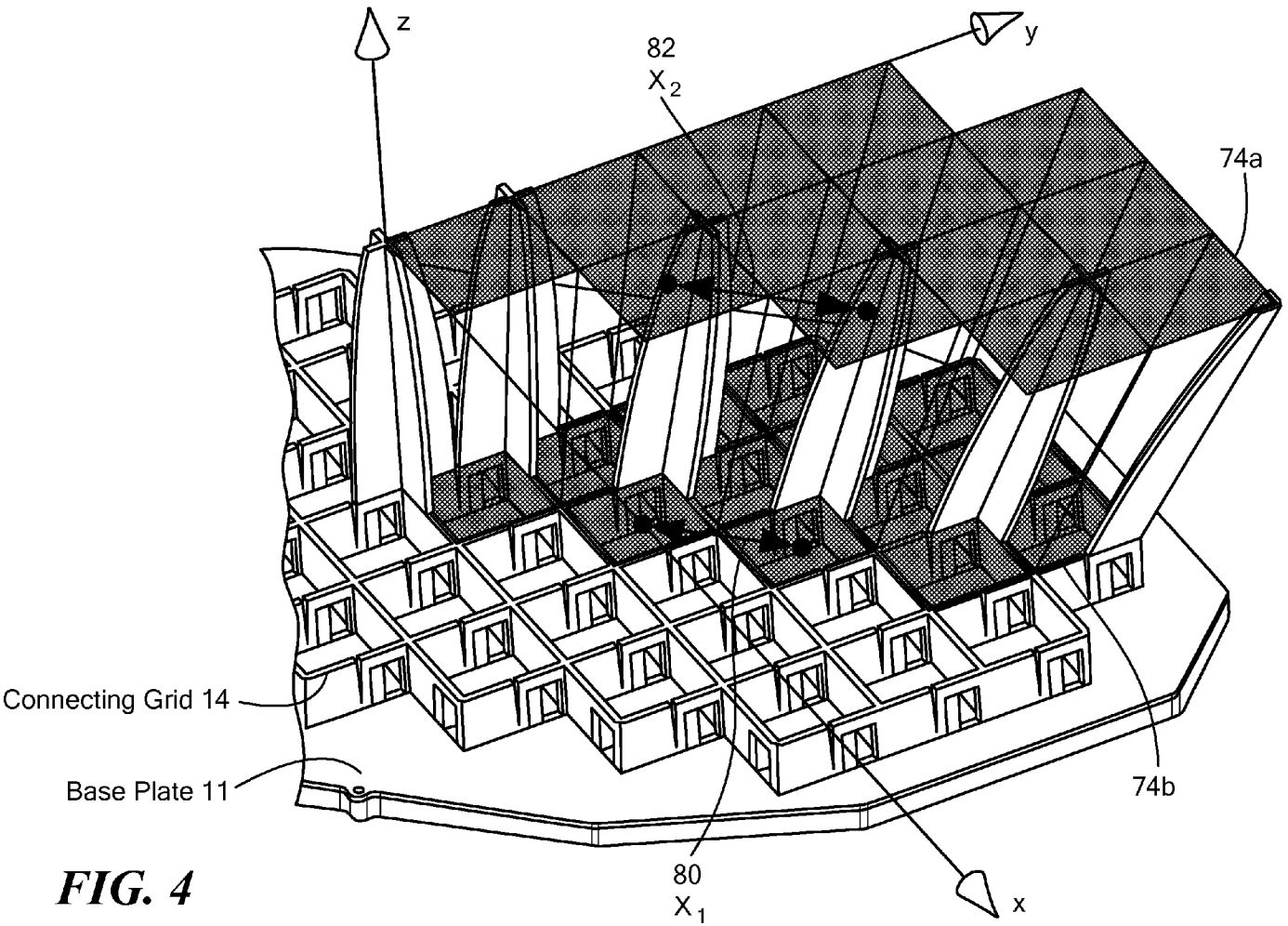
FIG. 4 is an isometric view of unit cells of an expanding lattice notch array, which may be the same as or similar to the expanding notch arrays of FIG. 1, 1A, or 3.

Now referring to FIG. 4, a spacing (i.e., center-to-center unit cell spacing) 80 (e.g., x1) between notch antenna elements 12 at a bottom of the notch array antenna 10 is different than a spacing 82 (e.g., x2) between notch antenna elements 12 at a top of the notch array antenna 10. The angles of the notch antenna elements 12 and their respective length can be varied causing the spacing 82 between top unit cells to be different relative to a corresponding bottom unit cell change.

This expansion of the spacing 80, 82 between notch antenna elements 12 provides a larger lattice spacing at the array aperture which can improve a gain performance of the notch array antenna 10, while maintaining the overall height of the notch array antenna 10. This manipulation of the lengths of one notch element 12 relative to another can improve the performance of notch array antenna 10, without altering the dimensions (e.g., height) restrictions of a particular application of the notch array antenna 10.

The surface of base plate 11 may optionally include connecting grid 14 to receive and mechanically and/or electrically couple notch antenna elements 12 to base plate 11. In some embodiments, the connecting grid 14 may be provided having an egg-crate structure to receive and couple to dual-polarized notch antenna elements 12. Notch antenna elements 12 may be provided from intersecting fin shaped conductors 20, 22 and be formed into a tree shape configuration. The tree shape configuration may be coupled to at least one of the egg-crate formations on the surface of base plate 11. Notch antenna elements 12 may be mounted to the surface of base plate 11 atop balun gridwork with alignment features such as pins and slots. In other embodiments, notch antenna elements 12 may be coupled to base plate 11 by machining on a surface of base plate 11 or by providing the notch elements 12 as a near-net cast part.

Figure 4A:
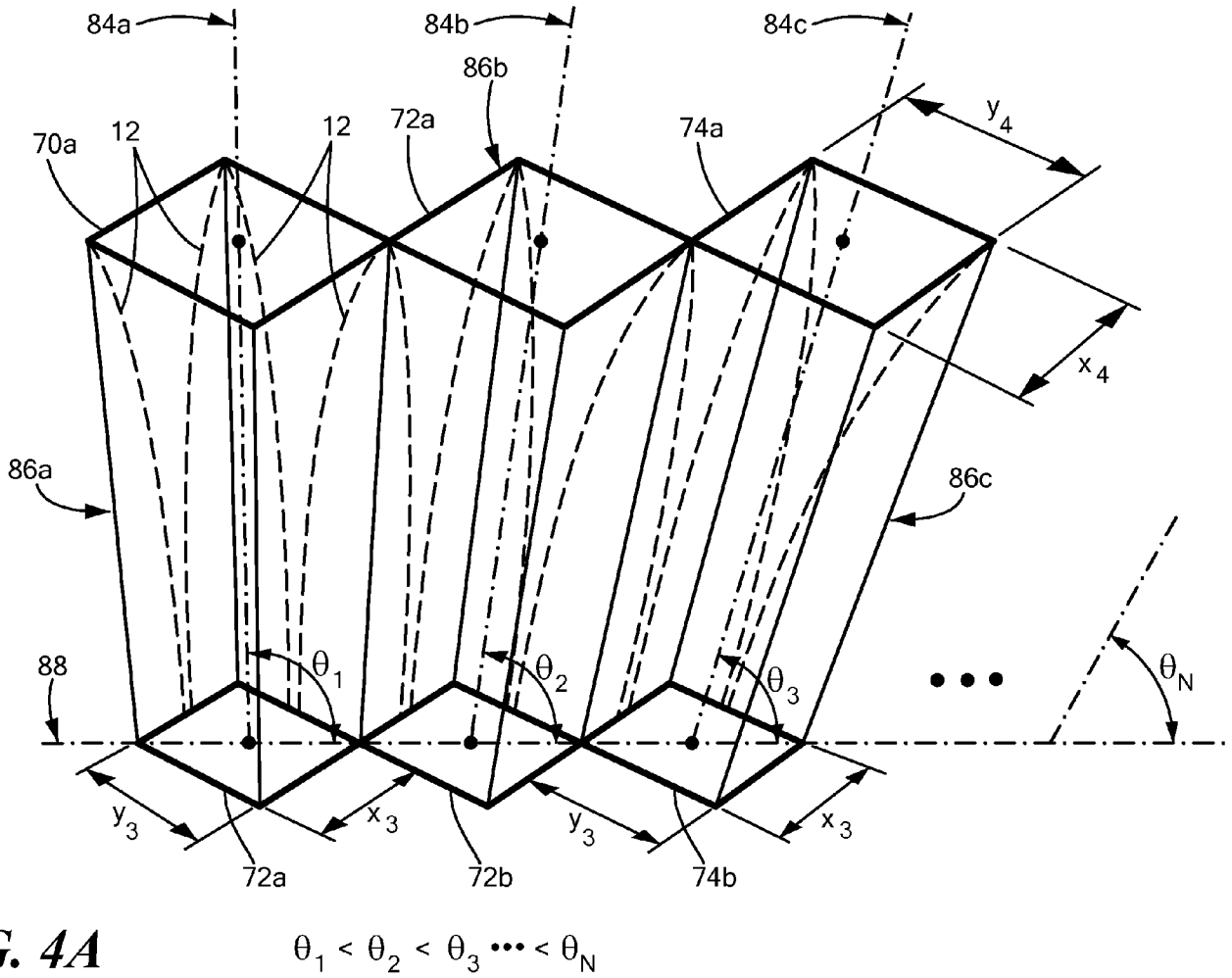
FIG. 4A is an isometric view of the unit cells and notch antenna elements of FIG. 4.

Now referring to FIG. 4A, each of the top area unit cells 70*a*, 72*a*, 74*a* have a larger area than each of the bottom area unit cells 70*b*, 72*b*, 74*b*. An area of the top area unit cells 70*a*, 72*a*, 74*a* may be defined by a length multiplied by the width (e.g., $X_4\times Y_4$) and an area of the bottom area unit cells 70*b*, 72*b*, 74*b* may also be defined by the length multiplied by the width ($X_3\times Y_3$). Due the area differences between the top and bottom area unit cells, an expansion occurs in the array aperture from the bottom to the top of the notch array antenna. Furthermore, there is some displacement from a bottom area unit cell to a corresponding top area unit cell. Thus, an angle, $\theta_N$, of a central axis 84 of each unit cell 86, relative to a surface 88 (e.g., surface of base plate 11), may vary depending on a distance from a central expansion point of the notch array antenna.

For example, a first unit cell 86*a* has a central axis 84*a* that extends from the surface 88 at an angle $\theta_1$. A second unit cell 86*b* has a central axis 84*b* that extends from the surface 88 at an angle $\theta_2$. A third unit cell 86*c* has a central axis 84*c* that extends from the surface 88 at an angle $\theta_3$. In an embodiment, the first unit cell 86*a* is the closest to the central expansion point of the notch array antenna and the third unit cell 86*c* is the farthest away from the central expansion point. Thus, angles of each central axis 84 of each unit cell 86 may have a relationship defined whereby $\theta_1<\theta_2<\theta_3<\ldots<\theta_N$, where $\theta_1$ represents an angle of central axis 84 of a unit cell 86 that is closest or nearest to a central expansion point of a notch array antenna and $\theta_N$ represents an angle of central axis of a unit cell 86 that is at a farthest point from a central expansion point of a notch array antenna.

The antenna designs and design techniques described herein have application in a wide variety of different applications. For example, the antennas may be used as active or passive antenna elements for missile sensors that require bandwidth, higher gain to support link margin, and wide impedance bandwidth to support higher data-rates, within a small volume. They may also be used as antennas for land-based, sea-based, or satellite communications. Because antennas having small antenna volume are possible, the antennas are well suited for use on small missile airframes. The antennas may also be used in, for example, handheld communication devices, commercial aircraft communication systems, automobile-based communications systems (e.g., personal communications, traffic updates, emergency response communication, collision avoidance systems, etc.), Satellite Digital Audio Radio Service (SDARS) communications, proximity readers and other RFID structures, radar systems, global positioning system (GPS) communications, and/or others. In at least one embodiment, the antenna designs are adapted for use in medical imaging systems. The antenna designs described herein may be used for both transmit and receive operations. Many other applications are also possible.

It should of course be understood that while the present technology has been described with respect to disclosed embodiments, numerous variations, alternate embodiments, equivalents, etc. are possible without departing from the spirit and scope of the claims. For example, any of a number of elements may be used in the phased array. Dual polarization systems with the two polarizations not oriented orthogonal to one another are another obvious variation.

In addition, it is intended that the scope of the present claims include all other foreseeable equivalents to the elements and structures as described herein and with reference to the drawing figures. Accordingly, the subject matter sought to be protected herein is to be limited only by the scope of the claims and their equivalents.

Having described preferred embodiments which serve to illustrate various concepts, structures and techniques, which are the subject of this patent, it will now become apparent to those of ordinary skill in the art that other embodiments incorporating these concepts, structures and techniques may be used. For example, it should be noted that individual concepts, features (or elements) and techniques of different embodiments described herein may be combined to form other embodiments not specifically set forth above. Furthermore, various concepts, features (or elements) and techniques, which are described in the context of a single embodiment, may also be provided separately or in any suitable sub-combination. It is thus expected that other embodiments not specifically described herein are also within the scope of the following claims.

Accordingly, it is submitted that that scope of the patent should not be limited to the described embodiments, but rather should be limited only by the spirit and scope of the following claims.

All publications and references cited herein are expressly incorporated herein by reference in their entirety.

What is claimed:

1. An expanding lattice notch antenna comprising:

a base plate having first and second opposing surfaces;

a plurality of notch antenna elements organized in a regular spacing in one or two directions along the first surface of the base plate, wherein each of the plurality of notch antenna elements is formed by a gap between conductive parts projecting from the first surface of the base plate;

a plurality of notch antenna element axes, wherein each notch antenna element axis is defined along a centerline of one of the plurality of notch antenna elements, each notch antenna element axis extending from the first surface of the base plate at systematically varying angles with respect to an axis perpendicular to the base plate, and each notch antenna element axis in each of the plurality of notch antenna elements having systematically varying lengths, such that a plurality of first endpoints of each notch antenna element axis lie on a plane equidistant in a perpendicular direction to the first surface of the base plate, forming a notch array antenna.

2. The antenna of claim 1, wherein a spacing between a plurality of second endpoints of each notch antenna axis at a bottom of the notch array antenna is less than the spacing between the plurality of first endpoints of each notch antenna axis at a top of the notch array antenna.

3. The antenna of claim 1, wherein the baseplate includes an open grid such that the base plate is defined by the plurality of second endpoints of each notch antenna axis at the bottom of the notch array antenna.

4. The antenna of claim 1, wherein an angle that a notch antenna element extends from the first surface of the substrate with respect to a surface plane of the substrate decreases as a distance of the notch antenna element from a central point of the notch array antenna increases.

5. The antenna of claim 1, wherein each of the plurality of notch antenna elements comprises two intersecting planar elements.

6. The antenna of claim 1, wherein a base area of each of the plurality of notch antenna elements is greater than a top area of each of the plurality of notch antenna elements.

7. The antenna of claim 1, wherein a base area of each of the plurality of notch antenna elements is less than a top area of each of the plurality of notch antenna elements.

8. The antenna of claim 1, wherein a spinal vector of each of the plurality of notch antenna elements is different from a spinal vector of at least one other notch antenna element with respect to a spinal vector at a central point of the notch array antenna.

9. The antenna of claim 1, wherein the plane equidistant in a perpendicular direction to the first surface of the base plate is a constant height and each of the notch antenna elements extending from the first surface of the base plate have varying lengths.

10. The antenna of claim 1, wherein the notch antenna element axis includes a first portion that is substantially straight with respect to the first surface of the base plate, a second portion disposed at a second angle with respect to the first surface of the base plate, and a third portion that is substantially straight with respect to the first surface of the base plate.

11. The antenna of claim 1, wherein the notch antenna element axis includes a first portion disposed at a first angle with respect to the first surface of the base plate, a second portion that is substantially straight with respect to the first surface of the base plate, and a third portion disposed at a third angle with respect to the first surface of the base plate.

12. A tapered notch array comprising:

a base plate having first and second opposing surfaces;

a plurality of notch antenna elements organized in a regular spacing in one or two directions along the first surface of the base plate, wherein each of the plurality of notch antenna elements is formed by a gap between conductive parts projecting from the first surface of the base plate;

wherein each of the plurality of notch antenna elements has a notch antenna axis corresponding to a longitudinal axis of the notch antenna element, and wherein each notch antenna axis is different from at least one other notch antenna axis;

a plurality of notch antenna element axes, wherein each notch antenna element axis is defined along a centerline of one of the plurality of notch antenna elements, each notch antenna element axis extending from the first surface of the base plate at systematically varying angles with respect to an axis perpendicular to the base plate, and each notch antenna element axis in each of the plurality of notch antenna elements having systematically varying lengths, such that a plurality of first endpoints of each notch antenna element axis lie on a plane equidistant in a perpendicular direction to the first surface of the base plate, forming a notch array antenna.

13. The array of claim 12, wherein each notch antenna element axis in each of the plurality of notch antenna elements has systematically varying lengths, such that a plurality of first endpoints of each notch antenna element axis lie on a plane equidistant in a perpendicular direction to the first surface of the base plate.

14. The antenna of claim 13, wherein a spacing between a plurality of second endpoints of each notch antenna axis at a bottom of the notch array antenna is less than the spacing between the plurality of first endpoints of each notch antenna axis at a top of the notch array antenna.

15. The antenna of claim 12, wherein the baseplate includes an open grid such that the base plate is defined by the plurality of second endpoints of each notch antenna axis at the bottom of the notch array antenna.

16. The antenna of claim 12, wherein an angle that a notch antenna element extends from the first surface of the substrate with respect to a surface plane of the substrate decreases as a distance of the notch antenna element from a central point of the notch array antenna increases.

17. The antenna of claim 12, wherein a base area of each of the plurality of notch antenna elements is greater than a top area of each of the plurality of notch antenna elements.

18. The antenna of claim 12, wherein a base area of each of the plurality of notch antenna elements is less than a top area of each of the plurality of notch antenna elements.

19. The antenna of claim 12, wherein the plane equidistant in a perpendicular direction to the first surface of the base plate is a constant height and each of the notch antenna elements extending from the first surface of the base plate have varying lengths.

20. The antenna of claim 12, wherein the notch antenna element axis includes a first portion that is substantially straight with respect to the first surface of the base plate, a second portion disposed at a second angle with respect to the first surface of the base plate, and a third portion that is substantially straight with respect to the first surface of the base plate.

* * * * *